US006033325A

United States Patent [19]

Hong

[11] Patent Number: 6,033,325

[45] Date of Patent: Mar. 7, 2000

[54] GAME RACKET HANDLE HAVING ADJUSTABLE LENGTH

[76] Inventor: Arthur Hong, No. 153, Sec. 3, Chung San Road, Tan Tsu Hsian, Taichung Hsien, Taiwan

[21] Appl. No.: 09/225,739

[22] Filed: Jan. 6, 1999

[30] Foreign Application Priority Data

Apr. 14, 1998 [TW] Taiwan ..... 87205578

[51] Int. Cl.[7] ..... A63B 49/08

[52] U.S. Cl. ..... 473/552

[58] Field of Search ..... 473/549, 552, 473/296

[56] References Cited

U.S. PATENT DOCUMENTS

| | | | |
|---|---|---|---|
| 3,833,218 | 9/1974 | Frenkel et al. | 473/531 |
| 4,101,125 | 7/1978 | Heath | 473/552 |
| 4,537,399 | 8/1985 | Adam | 473/552 |
| 4,545,584 | 10/1985 | Adam | 473/552 |

FOREIGN PATENT DOCUMENTS

| | | | |
|---|---|---|---|
| 1112435 | 8/1961 | Germany | 473/FOR 183 |
| 39 41 411 | 8/1990 | Germany | 473/FOR 183 |

*Primary Examiner*—Raleigh W. Chiu
*Attorney, Agent, or Firm*—Browdy and Neimark

[57] ABSTRACT

A game racket handle is adjustable in length and is composed of a main body, a jacket, and a bolt. The main body is fastened at one end thereof with a game racket shaft and provided at other end thereof with a threaded hole. The jacket has a closed end and an open end. The closed end is provided with a through hole. The jacket is movably fitted over the main body such that the jacket can displace along the direction of the longitudinal axis of the main body. The bolt is fastened pivotally with the closed end of the jacket and engaged with the threaded hole of the main body for regulating the position adjustment of the jacket in relation to the main body.

5 Claims, 2 Drawing Sheets

GAME RACKET HANDLE HAVING ADJUSTABLE LENGTH

FIELD OF THE INVENTION

The present invention relates generally to a game racket, and more particularly to a game racket handle adjustable in length.

BACKGROUND OF THE INVENTION

The conventional game rackets have a handle which can not be adjusted in length. As a result, it is often difficult and troublesome for a tall person with long arms to find a suitable game racket among the game rackets of various brands and sizes. It is therefore necessary for the tall person to compromise with the conventional game racket that he or she has chosen.

SUMMARY OF THE INVENTION

The primary objective of the present invention is to provide an improved game racket which has a handle adjustable in length to meet the requirement of a user of the game racket.

In keeping with the principle of the present invention, the foregoing objective of the present invention is achieved by a game racket handle consisting of a handle main body, a handle jacket fitted over the handle main body, and a bolt engaged with a threaded hole of the free end of the handle main body. The handle jacket is tubular in construction and is provided with a closed end and an open end through which the jacket is fitted over the main body such that the jacket can be displaced along the direction of the longitudinal axis of the main body. The bolt is intended to control the displacement of the jacket.

DETAILED DESCRIPTION OF THE INVENTION

Figure 1:
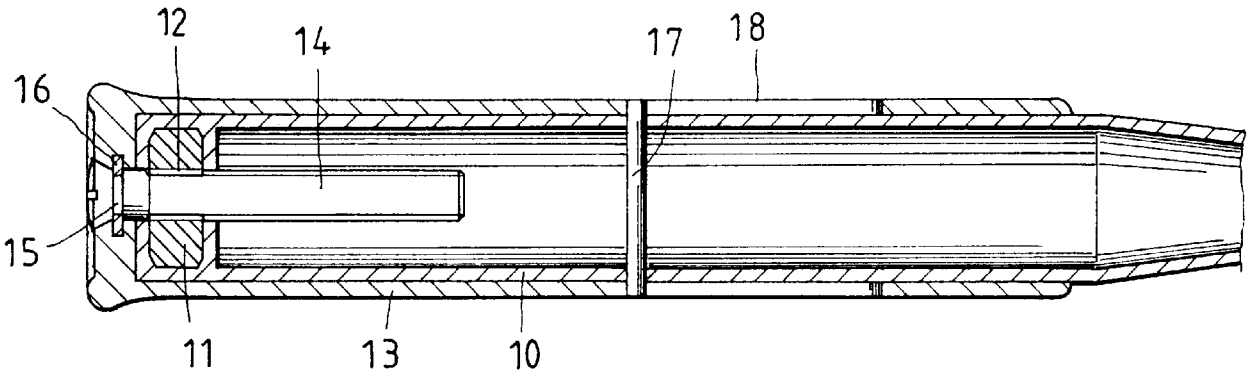
FIG. 1 shows a schematic view of a first preferred embodiment of the present invention.
Figure 2:
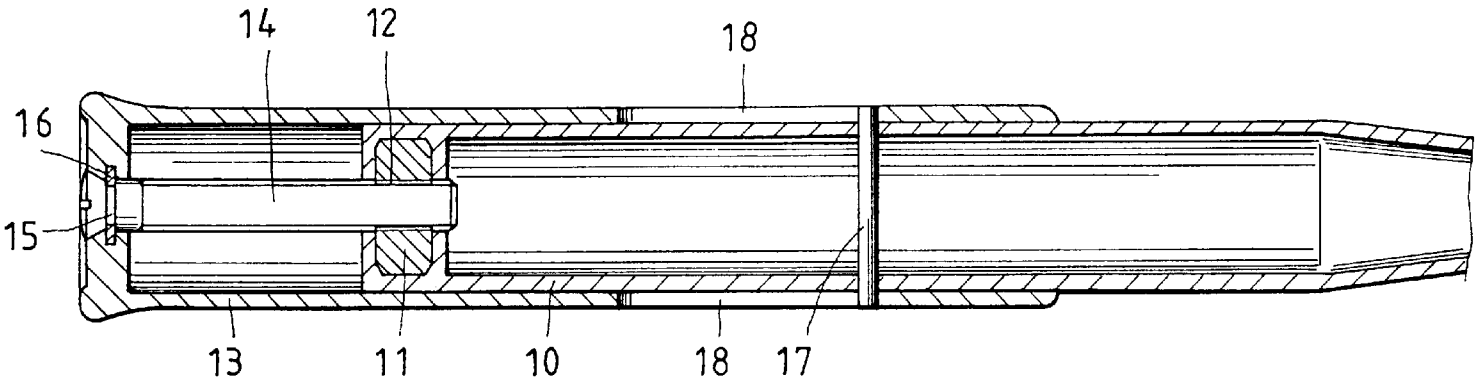
FIG. 2 shows a schematic view of the length adjustment of the first preferred embodiment of the present invention.

As shown in FIGS. 1 and 2, a game racket handle of the first preferred embodiment of the present invention is composed of a handle main body 10, a handle jacket 13, and a bolt 14.

The handle main body 10 is fastened at one end thereof with a game racket shaft (not shown in the drawing) and is provided at the free end thereof with a threaded hole 12. The main body 10 is made of a carbon fiber material which is preimpregnated with resin and is made integrally with a game racket frame. The main body 10 may be made of a fiber-reinforced resin material, fiber-reinforced plastic material, or wooden material. The threaded hole 12 is provided in the bottom thereof with a nut 11.

The handle jacket 13 is made of a plastic or nylon material by injection molding. The handle jacket 13 has a considerable hardness and a tubular body. The jacket 13 is provided with a closed end and an open end opposite to the closed end. The jacket 13 is fitted over the main body 10 from its open end and the free end of the main body 10 such that the jacket 13 can be displaced back and forth along the direction of the longitudinal axis of the main body 10.

The bolt 14 is provided with a circular slot 15 contiguous to the head of the bolt 14. A locating member 16, such as a C-shaped retaining ring, is fitted into the circular slot 15. The bolt 14 is made integrally with the jacket 13 by injection molding. The locating member 16 is thus embedded in the center of the closed end of the jacket 13. The bolt 14 can be turned without displacing axially or disengaging the jacket 13. The bolt 14 is engaged with the threaded hole 12 of the main body 10.

The jacket 13 can be adjusted in position relative to the main body 10 by adjusting the engagement depth of the bolt 14 in the threaded hole 12. As shown in FIG. 1, the bolt 14 is tightened to a maximal extent, the main body 10 is thus completely fitted over lengthwise by the jacket 13. As a result, the game racket handle has the shortest length. On the other hand, as shown in FIG. 2, the bolt 14 is loosened to a maximal extent, the jacket 13 is moved partially out of the main body 10. As a result, the game racket handle has the greatest length.

In order to prevent the jacket 13 from slipping off of the main body 10, the main body 10 is provided with a position confining pin 17, whereas the jacket 13 is provided with two long slot holes 18 corresponding respectively in location to both ends of the pin 17 so as to enable the jacket 13 to displace along the direction of the longitudinal axis of the main body 10, without enabling the jacket 13 to turn or slip off of the main body 10.

Figure 3:
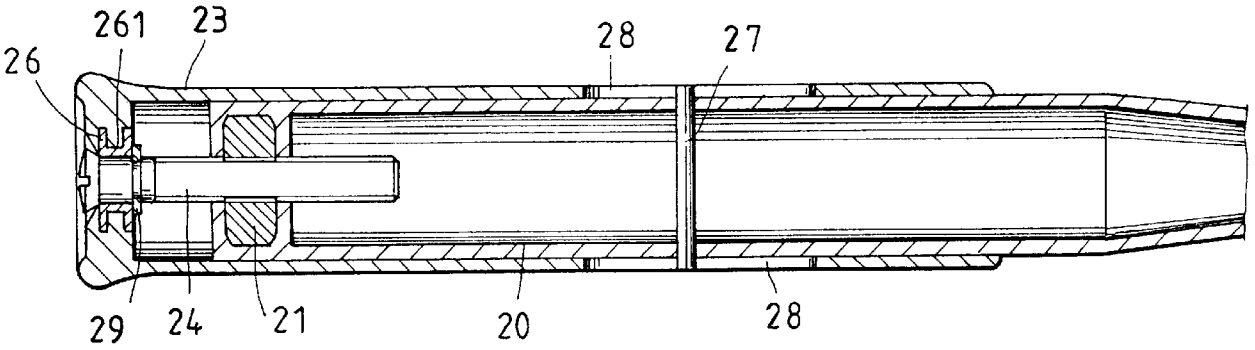
FIG. 3 shows a schematic view of a second preferred embodiment of the present invention.

As shown in FIG. 3, a game racket handle of the second preferred embodiment of the present invention is composed of a handle main body 20, a nut 21, a handle jacket 23, a bolt 24, a locating member 26, a position confining pin 27, and two long slot holes 28. The second preferred embodiment of the present invention is different from the first preferred embodiment of the present invention in that the locating member 26 of the former is of a ring-shaped construction and is provided in the periphery thereof with a circular slot 261 which is fitted over the bolt 24 and located by a C-shaped retaining ring 29. The locating member 26 and the handle jacket 23 are made integrally by injection molding. The bolt 24 is not in contact with the jacket 23.

Figure 4:
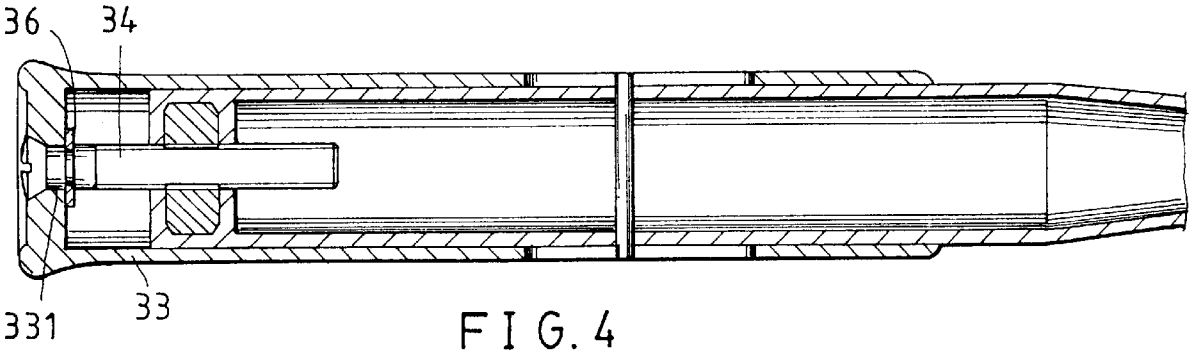
FIG. 4 shows a schematic view of a third preferred embodiment of the present invention.

As shown in FIG. 4, a game racket handle of the third preferred embodiment of the present invention is composed of a handle jacket 33 which is provided at the bottom end thereof with a through hole 331 through which a bolt 34 is put such that the bolt 34 is provided with a locating member 36 (a C-shaped retaining ring) fastened rotatably therewith, thereby enabling the bolt 34 to turn without slipping out.

Figure 5:
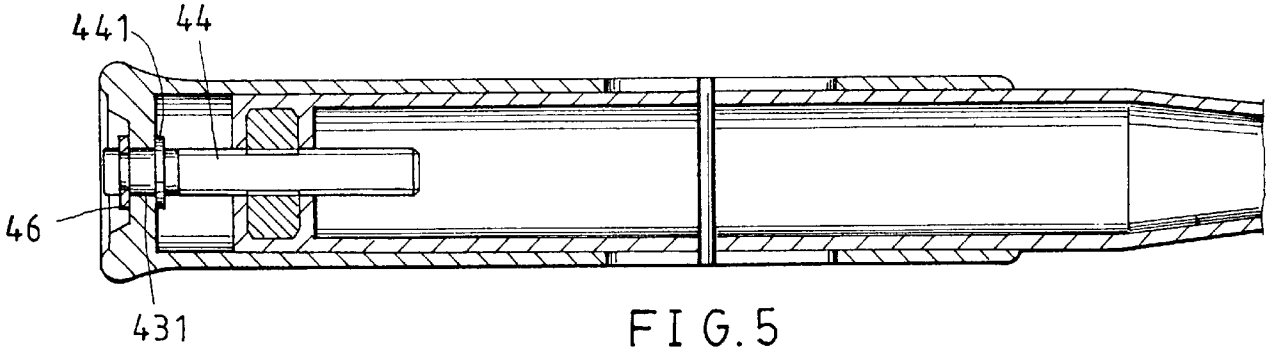
FIG. 5 shows a schematic view of a fourth preferred embodiment of the present invention.

As shown in FIG. 5, a game racket handle of the fourth preferred embodiment of the present invention is composed of a handle jacket 43 which is provided at the bottom end thereof with a through hole 431, and a bolt 44 without a head. The bolt 44 is provided with a locating portion 441. The bolt 44 is put through the jacket 43 such that the inner wall of the closed end of the jacket 43 is pressed against by the locating portion 441, and that the exposed end of the bolt 44 is provided with a C-shaped retaining ring 46 for confining the bolt 44 in the through hole 431. The bolt 44 can be thus turned without displacing or slipping out.

What is claimed is:

1. A game racket handle having an adjustable length, said handle comprising:

a handle main body fastened at a first end thereof with a game racket shaft and provided at a second end thereof with a threaded hole;

a handle jacket of a tubular construction and having a closed end and an open end opposite to said closed end, said jacket being slidably fitted over said main body such that said jacket can displace along the direction of the longitudinal axis of the main body; and a bolt rotatably fastened with said closed end of said jacket and engaged with said threaded hole of said main body for adjusting the position of said jacket in relation to said main body;

wherein said closed end of said handle jacket is provided with a through hole; and wherein said bolt is devoid of a head and is provided with a locating portion, said bolt being put through said through hole of said closed end of said jacket such that inner wall of said closed end of said jacket is pressed against by said locating portion of said bolt, and that an exposed end of said bolt is located by a C-shaped retaining ring.

2. A game racket handle having an adjustable length, said handle comprising:

a handle main body fastened at a first end thereof with a game racket shaft and provided at a second end thereof with a threaded hole;

a handle jacket of a tubular construction and having a closed end and an open end opposite to said closed end, said jacket being slidably fitted over said main body such that said jacket can displace along the direction of the longitudinal axis of the main body; and a bolt rotatably fastened with said closed end of said jacket and engaged with said threaded hole of said main body for adjusting the position of said jacket in relation to said main body;

wherein said bolt is provided with a locating member fastened rotatably therewith such that said locating member is embedded into said closed end of said jacket;

wherein said bolt is provided with a circular slot; and wherein said locating member is a C-shaped retaining ring, which is retained in said circular slot.

3. A game racket handle having an adjustable length, said handle comprising:

a handle main body fastened at a first end thereof with a game racket shaft and provided at a second end thereof with a threaded hole;

a handle jacket of a tubular construction and having a closed end and an open end opposite to said closed end, said jacket being slidably fitted over said main body such that said jacket can displace along the direction of the longitudinal axis of the main body; and a bolt rotatably fastened with said closed end of said jacket and engaged with said threaded hole of said main body for adjusting the position of said jacket in relation to said main body;

wherein said bolt is provided with a locating member fastened rotatably therewith such that said locating member is embedded into said closed end of said jacket;

wherein said locating member is of a ring-shaped construction and is fitted over said bolt such that said locating member is confined between the head of said bolt and a C-shaped retaining ring fitted over said bolt.

4. A game racket handle having an adjustable length, said handle comprising:

a handle main body fastened at a first end thereof with a game racket shaft and provided at a second end thereof with a threaded hole;

a handle jacket of a tubular construction and having a closed end and an open end opposite to said closed end, said jacket being slidably fitted over said main body such that said jacket can displace along the direction of the longitudinal axis of the main body; and a bolt rotatably fastened with said closed end of said jacket and engaged with said threaded hole of said main body for adjusting the position of said jacket in relation to said main body;

wherein said bolt is provided with a locating member fastened rotatably therewith such that said locating member is embedded into said closed end of said jacket;

wherein said locating member and said handle jacket are made integrally by injection molding.

5. A game racket handle having an adjustable length, said handle comprising:

a handle main body fastened at a first end thereof with a game racket shaft and provided at a second end thereof with a threaded hole;

a handle jacket of a tubular construction and having a closed end and an open end opposite to said closed end, said jacket being slidably fitted over said main body such that said jacket can displace along the direction of the longitudinal axis of the main body; and a bolt rotatably fastened with said closed end of said jacket and engaged with said threaded hole of said main body for adjusting the position of said jacket in relation to said main body;

wherein said main body is provided with a position confining pin; and wherein said jacket is provided with two slot holes corresponding respectively in location to both ends of said pin, so as to enable said jacket to displace along the direction of a longitudinal axis of said main body such that said jacket can neither turn in relation to said main body nor slip out of said main body.

* * * * *